United States Patent [19]

Bente

[11] 4,309,834

[45] Jan. 12, 1982

[54] CROSS COUNTRY SKI BOOT

[75] Inventor: Alfred Bente, Herzogenaurach, Fed. Rep. of Germany

[73] Assignee: Adidas Sportschuhfabriken Adi Dassler KG, Herzogenaurach, Fed. Rep. of Germany

[21] Appl. No.: 123,083

[22] Filed: Feb. 20, 1980

[30] Foreign Application Priority Data

Feb. 20, 1979 [DE] Fed. Rep. of Germany ..... 2906484

[51] Int. Cl.[3] ..... A43B 5/04; A43C 9/00

[52] U.S. Cl. ..... 36/117; 280/615

[58] Field of Search ..... 36/117, 118, 119, 120, 36/121; 280/611, 614, 615, 623

[56] References Cited

U.S. PATENT DOCUMENTS

| | | | |
|---|---|---|---|
| 3,870,325 | 3/1975 | Davis | 36/121 |
| 3,955,825 | 5/1976 | Kubelka et al. | 36/117 |
| 4,185,500 | 2/1980 | Salzman | 36/117 |

*Primary Examiner*—Patrick D. Lawson

[57] ABSTRACT

The invention relates to a cross country ski boot comprising a front sole extension by which it is fixed in a ski binding. At its front edge, the front sole extension comprises at least one forwardly open recess of which the lateral flanks come to lie closely against a supporting element of the ski binding upstanding substantially perpendicular to the upper surface of the ski. This provides additional retention of the ski boot in the ski binding helping to avoid play and resultant wobbling of the sole extension in the ski binding.

10 Claims, 2 Drawing Figures

CROSS COUNTRY SKI BOOT

Figure 1:
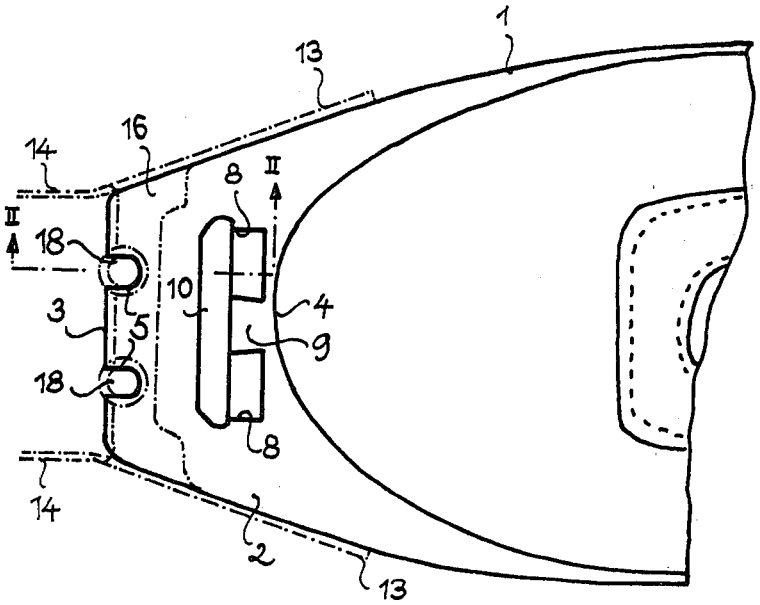

The invention relates to a cross country ski boot comprising a front sole projection which is insertable in a binding portion of a cross country ski binding that supports the sole projection at the sides and top and which is securable therein against rearward withdrawal by a retaining member.

Cross country ski boots are known of which the soles have a sole projection at the tip for use in securing the cross country ski boot in a ski binding, and particularly such cross country ski boots in which the sole projection is in the form of a front sole extension which extends forwardly considerably beyond the tip in order thereby to displace the rolling or bending zone further forwardly during use (see DE-OS 26 10 041). In these known cross country ski boots, in the condition of use, i.e. when the cross country ski boot is connected to the ski by the binding, the sole projection is held against moving upwardly and sidewardly by a binding portion of the ski binding whilst an actuatable retaining member or locking element fixes the ski boot against rearward withdrawal. In ski boots having a front sole extension (see DE-OS 26 10 041), the front end of the sole extension is clamped substantially rigidly in the binding portion of the ski binding so that loads on the ski boot occurring during use of the ski and the controlling forces exerted by the boot on the ski can be transmitted.

Particularly in the case of cross country ski boots having a front sole extension which is narrow in comparison with the sole projection of cross country ski boots according to the so-called Nordic standard (with a sole width of 75 mm), it is important to hold the sole extension as precisely and securely as possible, particularly in order to suppress undesired rotational movements of the ski boot about an axis perpendicular to the ski and an axis parallel to the longitudinal direction of the ski. This calls for a very accurate adaptation of the binding portion serving to restrain the sole projection or sole extension upwardly and sidewardly and possibly also of the retaining member in so far that the latter participates in the retaining effect in these directions. Play occurring between the sole extension and the binding member and also elastic deformations of the kind unavoidable particularly when the retaining member is elastically pressed against the sole projection could result in undesirable twist and rotation of the ski boot about the said axes.

It is therefore the object of the invention to provide a cross country ski boot of the aforementioned kind which, by means of the sole projection or sole extension, can be fixed against twisting and rotational motion about the said axes even without very accurate adaptation to the dimensions of the binding portion and also during possible elastic deformation of the retaining member or locking element of the cross country ski binding. Nevertheless, a simple coupling should be possible between the long-distance ski boot and the longdistance ski binding.

According to the invention, this object is achieved in that the sole projection is formed with at least one longitudinal slot which is open towards the front edge of the projection, extends rearwardly lengthwise of the boot and the lateral flanks of which, in engagement with the binding portion of the binding, closely embrace a supporting element associated with the binding portion and substantially perpendicular to the ski.

Preferably, this construction is provided for cross country ski boots in which the sole projection extends forwardly beyond the tip in the form of a front sole extension by a multiple of the sole thickness and the sole extension is itself formed with a projection which, in engagement with the binding portion, has the retaining member positively engaging behind it.

Surprisingly, it has been found that the rearwardly extending longitudinal slot starting at the front edge of the sole projection or sole extension provides an extraordinarily secure fixing against rotation and twisting of the ski boot about an axis perpendicular to the ski and an axis parallel to the longitudinal direction of the ski if the flanks of the slot closely embrace a suitably arranged supporting element provided in the ski binding. Since the longitudinal slot is open to the front, the sole projection or sole extension can be easily inserted in the binding portion, the supporting element there provided being introduced in the longitudinal slot. Contrary to known cross country ski bindings, therefore, the construction of the ski binding need take no account of the fact that pins provided on the binding portion are exposed at the top in which the skier must laboriously insert recesses at the underside of the supporting attachment to bring about the connection of the ski boot to the ski binding.

A cross country ski boot has already become known in which two longitudinal incisions are provided in the front end of the sole which slightly projects beyond the toe cap (DE-PS 26 22 966). However, these longitudinal incisions are intersected by a shaft which extends transversely to the length of the ski, is embedded in the outsole of the boot and behind which there can engage a retaining lever of the ski binding that can be swung in from above. Fixing of the cross country ski boot is therefore effected by the hook-like ends of the retaining lever which the skier must bring from above into the longitudinal recesses and behind the shaft.

The retaining effect in the cross country ski boot according to the invention is particularly good if, according to a development, the sole projection comprises a plurality of like longitudinal slots which co-operate with a corresponding number of supporting elements on the binding portion.

According to a further advantageous embodiment of the invention, it is provided that directly in front of the shoe tip the sole extension is provided with at least one recess, the hook-like end of the retaining member of the ski binding being adapted to engage behind the front edge of the recess or a part thereof. Such a recess at the same time facilitates the formation of predetermined flexibility of the sole extensions (see German patent application P 28 03 552.1) and serves as an engagement surface for the retaining element of the ski binding.

To ensure that desirable play-free co-operation of the longitudinal slot in the sole projection with the supporting element of the ski binding is maintained for as long as possible, a further development of the invention provides that the lateral flanks of the longitudinal slot are reinforced by a metal insert. This can, for example, be achieved in that a metal plate is embedded in the sole projection substantially parallel to its upper and lower sides and is exposed at the flanks of the longitudinal slot. Advantageously, two such metal plates are provided, one coming to lie near the upper side and the other near the lower side of the sole projection.

Figure 2:
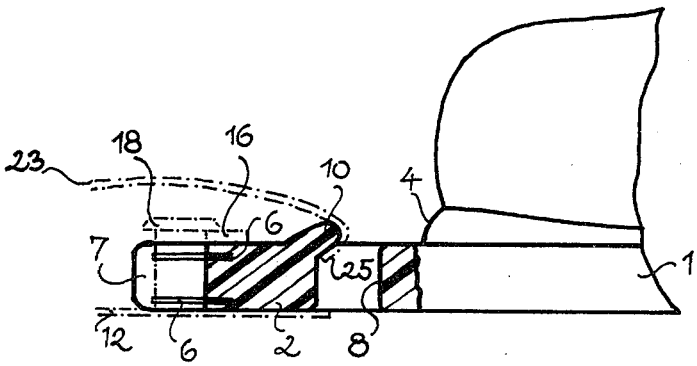

Further advantages and features of the invention will become evident from the following description of a preferred example with reference to the accompanying drawings, as well as from the subsidiary claims. In the drawings:

FIG. 1 is a plan view of the toe region of a cross country ski boot according to the invention and FIG. 2 is an enlarged side elevation of the same part of the boot partially sectioned on the line II—II in FIG. 1.

The cross country ski boot according to FIG. 1, for which only the toe-cap is illustrated for the sake of simplicity, comprises a sole 1 of hard but elastically bendable plastics material, e.g. hard polyamide, or of rubber. The sole 1 is extended at the front beyond the toe cap to form a sole extension 2 of which the front edge 3 is, for example, disposed 25 mm in front of the toe cap 4. The sole extension 2 uniformly converges forwardly so that it only has a width of, say,, 50 mm at the front edge 3.

Two longitudinal slots 5 provided in the sole extension 2 extend from the front edge 3 and pass through the entire thickness of the sole extension 2 (FIG. 2) and are rounded at their rear end. The longitudinal slots 5 are disposed symmetrically to the middle of the edge 3 and thus also substantially symmetrical to the longitudinal axis of the ski boot. As will be evident from FIG. 2, two metal plates 6 are embedded in the sole extension 2, of which one is disposed near the upper side and the other near the lower side of the sole extension 2. Part of the periphery of the metal plates 6 is exposed in the side flanks 7 of the longitudinal slots 5 and thus constitute reinforcement for reducing wear.

Just in front of the tip 4 of the sole, e.g. at a spacing of only 2 to 3 mm, the sole extension 2 also comprises two recesses 8 separated by a central web 9. The recesses 8 constitute holes extending from the top to the bottom of the sole extension 2. They are substantially rectangular (see FIG. 1), their confronting short sides being slightly oblique so that the central stay 9 diverges forwardly to a certain extent. The edges of the recesses are rounded as shown in FIG. 2 to avoid stress concentrations and cracks caused thereby. In the upper region of the front edge of the recesses 8 there is a transversely extending bar 10 which projects rearwardly and upwardly.

Co-operation of the sole extension 2 with an appropriate ski binding is indicated by the important components of the associated cross country ski binding shown in chain-dotted lines. It will be seen from FIG. 1 that the ski binding comprises two side walls 13 which serve as toe jaws, converge forwardly as viewed in plan and terminate in parallel walls 14. The side walls 13 are adjoined by a covering wall portion 16 which extends in the form of a bridge over the front end of the sole extension 2. The spacing of this bridge-like covering wall portion 16 from a base plate 12 of the ski binding on which the sole extension 2 rests in use, is substantially adapted to the thickness of the sole extension 2 at the front end region thereof (FIG. 2). Inserted in the covering wall portion 16 and the base plate 12 there are two supporting elements in the form of cylindrical pins 18 disposed at both sides of the medial longitudinal axis of the ski perpendicular to the ski. The pins are welded to the base plate and the covering wall portion 16. The diameter of the cylindrical pins 18 corresponds to the width of the longitudinal slots 5 so that their lateral flanks 7 embrace the pins 18 substantially without play during insertion of the sole extension 2.

To clamp the sole extension 2 in the ski binding, the latter further comprises a known retaining member 23 which is elastically constructed in the manner of a leaf spring and at its rear end carries two hook-like forwardly open fingers 25 (FIG. 2). In the condition of use, the hook-like fingers 25 engage behind the bar 10 provided at the upper edge of the recesses 8 and pull the sole extension 2 forwardly so that it is held between the side walls 13, under the covering wall portion 16 and by the pins 18. Fixing by the pins 18 is particularly effective if the rear rounded ends of the longitudinal slots 5 are pulled into abutment against the pins 18. However, this is not absolutely necessary for the intended function of the longitudinal slots 5 in conjunction with the pins 18.

It will be understood that within the scope of the invention departures can be made from the previously described example. Thus, the shape of the longitudinal slots 5 may be different as long as it is ensured that their side flanks closely embrace the supporting elements of the ski binding. It is conceivable that the longitudinal slots 5 may diverge forwardly so that supporting elements of complementary cross-section can be wedged therein.

Instead of the two recesses 8, there could also be a single throughgoing recess, in which case the rear end of the retaining member 23 of the cross country ski binding need not terminate in two separate hook-like fingers 25.

Finally, instead of the two metal plates 6 embedded in the sole extension 2 there may also be a single metal plate which can, for example be inserted centrally.

I claim:

1. In a cross country ski boot having a front sole projection insertable in a binding portion of a ski binding supporting the sole projection at the sides and top thereof and which is securable against rearward withdrawal by a retaining member, the improvement comprising at least one slot in said sole projection having lateral flanks open at the front edge of said projection over the entire thickness thereof and extending longitudinally and rearwardly of said boot, whereby when in engagement with said binding portion a supporting element engages said slot and is in supporting contact with said flanks over substantially the entire weight thereof which corresponds to the thickness of the sole projection.

2. A ski boot according to claim 1, wherein the sole projection extends forwardly beyond the tip in the form of a front sole extension by a multiple of the sole thickness and the sole extension is itself formed with a projection which, in engagement with the binding portion, has the retaining member positively engaging behind it.

3. A ski boot according to claim 1 or claim 2, wherein the sole projection comprises a plurality of like longitudinal slots which co-operate with a corresponding number of supporting elements on the binding portion.

4. A ski boot according to claim 3, wherein the longitudinal slots are disposed symmetrically to the middle of the front edge of the sole projection.

5. A ski boot according to claim 3, wherein the lateral flanks of each longitudinal slot are reinforced by a metal insert.

6. A ski boot according to claim 5, wherein the metal insert is at least one metal plate which is embedded in the sole projection substantially parallel to its upper and lower sides and is exposed at the flanks of each longitudinal slot.

7. A ski boot according to claim 6, wherein two parallel metal plates are embedded in the sole projection near the respective upper and lower side thereof.

8. A ski boot according to claim 3, wherein directly in front of the tip the sole projection is provided with at least one recess, the a end of the retaining member of the ski binding being adapted to engage behind the front edge of the recess or a part thereof.

9. A ski boot according to claim 8, wherein the upper region of the front edge of the recess has a rearwardly and/or upwardly projecting bar.

10. A ski boot according to claim 8, wherein a plurality of adjacent recesses are associated with a corresponding number of hook-like fingers of the retaining member of the ski binding.

* * * * *